US009944878B2

(12) United States Patent
Butke et al.

(10) Patent No.: US 9,944,878 B2
(45) Date of Patent: Apr. 17, 2018

(54) LUBRICANT SYSTEM CLEAN-UP COMPOSITIONS AND METHODS THEREOF

(75) Inventors: Betsy J. Butke, Mentor, OH (US); Grenville Holt, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 854 days.

(21) Appl. No.: 13/508,394

(22) PCT Filed: Oct. 14, 2010

(86) PCT No.: PCT/US2010/052601

§ 371 (c)(1), (2), (4) Date: Jun. 20, 2012

(87) PCT Pub. No.: WO2011/059626

PCT Pub. Date: May 19, 2011

(65) Prior Publication Data

US 2012/0247514 A1 Oct. 4, 2012

Related U.S. Application Data

(60) Provisional application No. 61/259,781, filed on Nov. 10, 2009.

(51) Int. Cl.

*C10M 133/00* (2006.01)
*C10M 133/56* (2006.01)
*C10M 169/04* (2006.01)

(52) U.S. Cl.

CPC ..... *C10M 133/56* (2013.01); *C10M 169/04* (2013.01); *C10M 2203/065* (2013.01); *C10M 2203/10* (2013.01); *C10M 2203/1006* (2013.01); *C10M 2205/223* (2013.01); *C10M 2207/125* (2013.01); *C10M 2207/126* (2013.01); *C10M 2207/281* (2013.01); *C10M 2207/2835* (2013.01); *C10M 2215/28* (2013.01); *C10M 2215/285* (2013.01); *C10M 2219/044* (2013.01); *C10M 2223/04* (2013.01); *C10M 2223/043* (2013.01); *C10M 2223/047* (2013.01); *C10N 2230/04* (2013.01); *C10N 2240/08* (2013.01); *C10N 2240/14* (2013.01); *C10N 2240/56* (2013.01)

(58) Field of Classification Search

CPC . C10M 159/00; C10M 159/12; C10M 133/00
See application file for complete search history.

(56) References Cited

U.S. PATENT DOCUMENTS

| | | | | |
|---|---|---|---|---|
| 4,108,858 | A * | 8/1978 | Malec | C07D 213/20 546/347 |
| 4,306,070 | A * | 12/1981 | Hammond | C07D 307/33 546/13 |
| 4,338,206 | A | 7/1982 | Hammond et al. | |
| 4,339,336 | A | 7/1982 | Hammond et al. | |
| 5,034,018 | A * | 7/1991 | Gutierrez et al. | 44/331 |
| 5,254,138 | A | 10/1993 | Kurek | |
| 2008/0113890 | A1 | 5/2008 | Moreton et al. | |
| 2009/0029888 | A1* | 1/2009 | Ravichandran et al. | 508/362 |
| 2009/0093384 | A1* | 4/2009 | Ward et al. | 508/205 |

FOREIGN PATENT DOCUMENTS

| | | |
|---|---|---|
| JP | 2002309279 | 10/2002 |
| WO | 2008027881 | 3/2008 |

OTHER PUBLICATIONS

Abstract of JP 2002309279, Patent Abstracts of Japan (2002), Nippon Oil Corp., published Oct. 23, 2002.
Written Opinion of corresponding International Application No. PCT/US2010/052601 dated Apr. 4, 2011.
Search Report from corresponding International Application No. PCT/US2010/052601 dated Apr. 4, 2011.

* cited by examiner

*Primary Examiner* — Gregory E Webb
(74) *Attorney, Agent, or Firm* — Thoburn T. Dunlap; Christopher D. Hilker

(57) ABSTRACT

The present invention relates to a lubricant and/or clean-out composition comprising: (a) a dispersant component comprising a succinimide dispersant and/or a quaternary ammonium salt dispersant; (b) a carrier fluid component; and (c) an optional corrosion inhibitor, as well as methods of cleaning out deposits in a lubricant system, such as a hydraulic system, using such compositions.

19 Claims, No Drawings

LUBRICANT SYSTEM CLEAN-UP COMPOSITIONS AND METHODS THEREOF

BACKGROUND OF THE INVENTION

The lubricant reservoirs, moving parts, filtration media and devices among other areas in the lubricant systems of industrial equipment can accumulate deposits due to the oxidation and/or thermal decomposition of the lubricant and/or additives present in the lubricant over time.

It is not uncommon, in some equipment and in some instances, for such equipment, and their lubricant systems, to operate over long periods of time without being drained and/or cleaned. These periods of time may even extend into five to ten years of operation without any such maintenance.

The deposits that can build up over these periods often impede heat transfer from the system and, when they accumulate on moving parts and other system mechanicals, cause malfunctions of these systems and components including sticking of critical valves and other parts. Such effects may result in unscheduled downtime and even significant damage to the piece of the equipment in question.

There is a need for compositions, and methods of using such compositions, that allow for the efficient and effective removal of such deposits from the lubricant systems, mechanical and electronic components, filters and filtration components of the equipment.

SUMMARY OF THE INVENTION

The present invention provides compositions, and methods of using such compositions, that allow for the efficient and effective removal of deposits from the lubricant systems of equipment. The compositions described here can be added as a concentrate and/or top treat to the oil in a system or added to a drained system as a lubricant composition. The equipment may be operated to circulate the composition throughout the lubricant system of the equipment, typically under low to no load conditions, allowing the composition to remove deposits from the surfaces and moving parts within the lubricant system. In some instances the composition is then drained, draining the removed deposits with it, and fresh lubricant is added to the system, resulting in a cleaned lubricant system.

The present invention provides a lubricant and/or clean-out composition comprising: (a) a dispersant component comprising a succinimide dispersant and/or a quaternary ammonium salt dispersant; (b) a carrier fluid component; and (c) an optional corrosion inhibitor.

In some embodiments the dispersant component is a dispersant that is the reaction product of a hydrocarbyl-substituted succinic acylating agent and a polyalkylene polyamine. In some embodiments the dispersant is a polyisobutylenesuccinimide dispersant.

In some embodiments the dispersant component is a quaternary ammonium salt that comprises the reaction product of: (a) the reaction product of (i) a hydrocarbyl-substituted acylating agent and (ii) a compound having an oxygen or nitrogen atom capable of condensing with said acylating agent and further having a tertiary amino group; and (b) a quaternizing agent suitable for converting the tertiary amino group to a quaternary nitrogen wherein the quaternizing agent is selected from the group consisting of dialkyl sulfates, benzyl halides, hydrocarbyl substituted carbonates; hydrocarbyl epoxides in combination with an acid or mixtures thereof. In some embodiments the quaternary ammonium salt is a polyisobutylene succinimide quaternary ammonium salt dispersant.

In some embodiments these compositions further include an ashless antiwear additive, such as a hydrocarbyl phosphoric acid or acid ester, a hydrocarbyl thiophosphoric acid or add ester, a hydrocarbyl dithiophosphoric acid or acid ester, an amine salt of one or more of these acids or acid esters, or combinations thereof.

The present invention also provides methods of using such compositions to clean out the lubricant system of a piece of equipment. These methods include the steps of (i) supplying a sufficient amount of the composition of claim 1 to a lubricant system such that the system may be safely operated; (ii) operating said system to circulate the composition throughout the system; resulting in the removal of deposits from the lubricant system.

In some embodiments the piece of equipment is operated at low load settings and/or conditions. In some embodiments the methods further include the step: (iii) after operating said system and removing the deposits, draining the lubricant system, including the composition of claim 1, and refilling the system with fresh lubricant.

DETAILED DESCRIPTION OF THE INVENTION

Various features and embodiments of the invention will be described below by way of non-limiting illustration.

The present invention provides compositions, and methods of using such compositions, that allow for the efficient and effective removal of deposits from the lubricant systems of equipment. The compositions described here can be added as a concentrate and/or top treat to the oil in a system or added to a drained system as a lubricant composition. The equipment may be operated to circulate the composition throughout the lubricant system of the equipment, typically under low to no load conditions, allowing the composition to remove deposits from the surfaces and moving parts within the lubricant system. In some instances the composition is then drained, draining the removed deposits with it, and fresh lubricant is added to the system, resulting in a cleaned lubricant system.

Equipment suitable for use with the compositions and methods of the present invention include but are not limited to equipment employing hydraulic fluids to convey or transfer power and turbine systems using fluids to lubricate bearing and other rotating components. Specific examples include hydraulic systems in plastic injection molding machines, hydraulic presses, steam or gas powered turbines, and the like.

The compositions of the present invention include (a) a dispersant component comprising a succinimide dispersant and/or a quaternary ammonium salt dispersant; (b) a carrier fluid component; and (c) an optional corrosion inhibitor.

The Dispersant Component

The compositions of the present invention include a dispersant component comprising a succinimide dispersant and/or a quaternary ammonium salt dispersant.

(i) The Succinimide Dispersant

In some embodiments the dispersant component includes a dispersant that is the reaction product of a hydrocarbyl-substituted acylating agent and a polyalkylene polyamine. Many hydrocarbyl-substituted acylating agents are useful in the present invention and include the reaction product of a long chain hydrocarbon, generally a polyolefin, with a monounsaturated carboxylic acid or derivative thereof. In some embodiments the dispersant component of the present invention includes a dispersant derived from a hydrocarbyl-substituted succinic acylating agent and a polyalkylene polyamine. Additional dispersants may also be present.

Monounsaturated carboxylic acids or derivatives thereof suitable for preparing the hydrocarbyl-substituted acylating agents include: (i) α,β-monounsaturated $C_4$ to $C_{10}$ dicarboxylic acids, such as fumaric acid, itaconic acid, and maleic acid; (ii) derivatives of (i), such as anhydrides or $C_1$ to $C_5$ alcohol derived mono- or di-esters of (i); (iii) α,β-monounsaturated $C_3$ to $C_{10}$ monocarboxylic acids, such as acrylic acid and methacrylic acid; or (iv) derivatives of (iii), such as $C_1$ to $C_5$ alcohol derived esters of (iii).

Suitable long chain hydrocarbons for use in preparing the hydrocarbyl substituted acylating agents include any compound containing an olefinic bond represented by the general Formula I, shown here:

$$(R^1)(R^2)C{=}C(R^3)(CH(R^4)(R^5)) \quad \text{(I)}$$

wherein each of $R^1$, $R^2$, $R^3$, $R^4$ and $R^5$ is, independently, hydrogen or a hydrocarbon based group. In some embodiments at least one of $R^3$, $R^4$ or $R^5$ is a hydrocarbon based group containing at least 20 carbon atoms.

These long chain hydrocarbons, which may also be described as polyolefins or olefin polymers, are reacted with the monounsaturated carboxylic acids and derivatives described above to form the hydrocarbyl substituted acylating agents used to prepare the nitrogen-containing detergent of the present invention. Suitable olefin polymers include polymers comprising a major molar amount of $C_2$ to $C_{20}$, or $C_2$ to $C_5$ mono-olefins. In other embodiments the olefin polymers comprise a minor amount of these olefins. Such olefins include ethylene, propylene, butylene, isobutylene, pentene, octene-1, or styrene. The polymers may be homopolymers, such as polyisobutylene, as well as copolymers of two or more of such olefins. Suitable copolymers include for example copolymers of ethylene and propylene, butylene and isobutylene, and propylene and isobutylene. Other suitable copolymers include those in which a minor molar amount of the copolymer monomers, e.g. 1 to 10 mole % is a $C_4$ to $C_{18}$ di-olefin. Such copolymers include for example a copolymer of isobutylene and butadiene; and a copolymer of ethylene, propylene and 1,4-hexadiene.

In one embodiment, at least one of the —R groups of Formula (I) shown above is derived from polybutene, that is, polymers of $C_4$ olefins, including 1-butene, 2-butene and isobutylene. $C_4$ polymers include polyisobutylene. In another embodiment, at least one of the —R groups of Formula I is derived from ethylene-alpha-olefin polymers, including ethylene-propylenediene polymers. Examples of documents that described ethylene-alpha-olefin copolymers and ethylene-lower olefin-diene terpolymers include U.S. Pat. Nos. 3,598,738; 4,026,809; 4,032,700; 4,137,185; 4,156,061; 4,320,019; 4,357,250; 4,658,078; 4,668,834; 4,937,299; and 5,324,800.

In another embodiment, the olefinic bonds of Formula (I) are predominantly vinylidene groups, represented by the following formula:

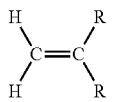

(II)

wherein each R is a hydrocarbyl group; which in some embodiments may be:

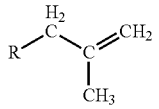

(III-a)

and/or

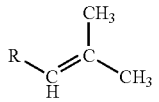

(III-b)

wherein each R is independently a hydrocarbyl group.

In one embodiment, the vinylidene content of Formula (I) may comprise at least 30 mole % vinylidene groups, at least 50 mole % vinylidene groups, or at least 70 mole % vinylidene groups. Such materials and methods of preparation are described in U.S. Pat. Nos. 5,071,919; 5,137,978; 5,137,980; 5,286,823, 5,408,018, 6,562,913, 6,683,138, 7,037,999; and United States publications: 2004/0176552A1; 2005/0137363; and 2006/0079652A1. Such products are commercially available from BASF, under the trade name GLISSOPALT™ and from Texas PetroChemical LP, under the trade name TPC 1105™ and TPC 595™.

Methods of making hydrocarbyl substituted acylating agents from the reaction of monounsaturated carboxylic acid reactants and compounds of Formula (I) are well know in the art and disclosed in U.S. Pat. Nos. 3,361,673; 3,401,118; 3,087,436; 3,172,892; 3,272,746; 3,215,707; 3,231,587; 3,912,764; 4,110,349; 4,234,435; 6,077,909; and 6,165,235.

In another embodiment, the hydrocarbyl substituted acylating agent can be made from the reaction of a compound represented by Formula (I) with at least one carboxylic reactant represented by the following formulas:

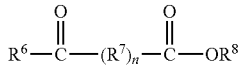

(IV)

and

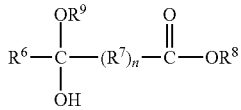

(V)

wherein each of $R^6$, $R^8$ and $R^9$ is independently H or a hydrocarbyl group, $R^7$ is a divalent hydrocarbylene group, and n is 0 or 1. Such compounds and the processes for making them are disclosed in U.S. Pat. Nos. 5,739,356; 5,777,142; 5,786,490; 5,856,524; 6,020,500; and 6,114,547.

In yet another embodiment, the hydrocarbyl substituted acylating agent may be made from the reaction of any compound represented by Formula (I) with any compound represented by Formula (IV) or Formula (V), where the reaction is carried out in the presence of at least one aldehyde or ketone. Suitable aldehydes include formaldehyde, acetaldehyde, propionaldehyde, butyraldehyde, isobutyraldehyde, pentanal, hexanal, heptaldehyde, octanal, benzaldehyde, as well as higher aldehydes. Other aldehydes, such as dialdehydes, especially glyoxal, are useful, although monoaldehydes are generally preferred. In one embodiment, the aldehyde is formaldehyde, which may be supplied in the aqueous solution often referred to as formalin, but which is more often used in the polymeric form referred to as paraformaldehyde. Paraformaldehyde is considered a reactive equivalent of and/or source of formaldehyde. Other reactive equivalents include hydrates or cyclic trimers. Suitable ketones include acetone, butanone, methyl ethyl ketone, as well as other ketones. In some embodiments, one of the two hydrocarbyl groups of the ketone is a methyl group. Mixtures of two or more aldehydes and/or ketones are also useful. Such hydrocarbyl substituted acylating agents and the processes for making them are disclosed in U.S. Pat. Nos. 5,840,920; 6,147,036; and 6,207,839.

In another embodiment, the hydrocarbyl substituted acylating agent may include methylene bis-phenol alkanoic acid compounds. Such compounds may be the condensation product of (i) an aromatic compound of the formula:

$$R_m—Ar—Z_c \quad (VI)$$

and (ii) at least one carboxylic reactant such as the compounds of formula (IV) and (V) described above, wherein, in Formula (VI): each R is independently a hydrocarbyl group; m is 0 or an integer from 1 up to 6 with the proviso that in does not exceed the number of valences of the corresponding Ar group available for substitution; Ar is an aromatic group or moiety containing from 5 to 30 carbon atoms and from 0 to 3 optional substituents such as amino, hydroxy- or alkyl-polyoxyalkyl, nitro, aminoalkyl, and carboxy groups, or combinations of two or more of said optional substituents; Z is independently —OH, —O, a lower alkoxy group, or $—(OR^{10})_bOR^{11}$ wherein each $R^{10}$ is independently a divalent hydrocarbyl group, b is a number from 1 to 30, and $R^{11}$ is —H or a hydrocarbyl group; and c is a number ranging from 1 to 3. As noted above m may be zero, in which case the Ar group does not contain any substituent groups other than Zc. In some embodiments, the R in formula (VI) may instead be defined as each being independently hydrogen or a hydrocarbyl group where m is an integer from 1 up to 6 with the proviso that m does not exceed the number of valences of the corresponding Ar group available for substitution.

In one embodiment, at least one hydrocarbyl group on the aromatic moiety is derived from polybutene. In one embodiment, the source of the hydrocarbyl groups described above are polybutenes obtained by polymerization of isobutylene in the presence of a Lewis acid catalyst such as aluminum trichloride or boron trifluoride.

Such compounds and the processes for making them are disclosed in U.S. Pat. Nos. 3,954,808; 5,336,278; 5,458,793; 5,620,949; 5,827,805; and 6,001,781.

In another embodiment, the reaction of (i) with (ii), optionally in the presence of an acidic catalyst such as organic sulfonic acids, heteropolyacids, and mineral acids, can be carried out in the presence of at least one aldehyde or ketone. The aldehyde or ketone reactant employed in this embodiment is the same as those described above. Such compounds and the processes for making them are disclosed in U.S. Pat. No. 5,620,949.

Still other methods of making suitable hydrocarbyl substituted acylating agents can be found in U.S. Pat. Nos. 5,912,213; 5,851,966; and 5,885,944.

Suitable polyalkylene polyamines for use in preparing the nitrogen-containing dispersant may be derived from an olefin polymer and an amine, such as ammonia, monoamines, polyamines or mixtures thereof. They may be prepared by a variety of methods. The polyalkylene polyamines of the present invention are not particularly limited in scope to the methods of their preparation disclosed hereinabove.

The polyalkylene polyamines may be derived from olefin polymers. Suitable olefin polymers for preparing the polyalkylene polyamines of the invention are the same as those described above in regards to the hydrocarbyl acylating agent.

The polyalkylene polyamines may be derived from ammonia, monoamines, polyamines, or mixtures thereof, including mixtures of different monoamines, mixtures of different polyamines, and mixtures of monoamines and polyamines (which include diamines). Suitable amines include aliphatic, aromatic, heterocyclic and carbocyclic amines.

In one embodiment, the amines may be characterized by the formula:

$$R^{12}R^{13}NH \quad (IX)$$

wherein $R^{12}$ and $R^{13}$ are each independently hydrogen, hydrocarbon, amino-substituted hydrocarbon, hydroxy-substituted hydrocarbon, alkoxy-substituted hydrocarbon, or acylimidoyl groups provided that no more than one of $R^{12}$ and $R^{13}$ is hydrogen. The amine may be characterized by the presence of at least one primary ($H_2N$—) or secondary amino (H—N<) group. These amines, or the polyalkene-substituted amines they are used to prepare may be alkylated as needed to ensure they contain at least one tertiary amino group. Examples of suitable monoamines include ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine.

The polyalkylene polyamines from which the dispersant is derived include principally alkylene amines conforming, for the most part, to the formula:

$$\begin{array}{l} HN—(Alkylene\text{-}N)_n—R^{14} \\ \quad\;\; | \qquad\qquad\quad | \\ \quad\;\; R^{14} \qquad\qquad R^{14} \end{array} \quad (X)$$

wherein n is an integer typically less than 10, each $R^{14}$ is independently hydrogen or a hydrocarbyl group typically having up to 30 carbon atoms, and the alkylene group is typically an alkylene group having less than 8 carbon atoms. The alkylene amines include principally, ethylene amines, hexylene amines, heptylene amines, octylene amines, other polymethylene amines. They are exemplified specifically by: ethylenediamine, diethylenetriamine, triethylene tetramine, propylene diamine, decamethylene diamine, octamethylene diamine, di(heptamethylene)triamine, tripropylene tetramine, tetraethylene pentamine, trimethylene diamine, pentaethylene hexamine, di(-trimethylene)triamine, aminopropylmorpholine and dimethylaminopropylamine. Higher homologues such as are obtained by condensing two or more of the above-illustrated alkylene amines likewise are useful. Tetraethylene pentamine is particularly useful.

The ethylene amines, also referred to as polyethylene polyamines, are especially useful. They are described in some detail under the heading "Ethylene Amines" in Encyclopedia of Chemical Technology, Kirk and Othmer, Vol. 5, pp. 898-905, Interscience Publishers, New York (1950).

In some embodiments the hydrocarbyl-substituted acylating agent may be a polyisobutylenesuccinie anhydride and the polyalkylene polyamine includes ethylenediamines, diethylenetriamine, triethylenetetramine, tris-(2-amino-ethyl)amine, propylenediamine, trimethylenediamine, tripropylenetetramine, tetraethylenepentamine, hexaethylenheptamine, pentaethylenehexamine, ethylenepolyamines, alkylcnepolyamine bottoms, and combinations thereof. In any of these embodiments the polyisobutylenesuccinic anhydride may be derived from polyisobutylene have a number average molecular weight (Mn) of about 500, 700 or 800 to 5000, 3000, 1500, or 1200.

(ii) The Quaternary Ammonium Salt Dispersant

In some embodiments the dispersant component is a quaternary ammonium salt. Examples of quaternary ammonium salt and methods for preparing the same are described in U.S. Pat. Nos. 4,253,980; 3,778,371; 4,171,959; 4,326,973; 4,338,206; and 5,254,138.

In some embodiments the quaternary ammonium salt of the present invention is the reaction product of: (a) the reaction product of (i) a hydrocarbyl-substituted acylating agent and (ii) a compound having an oxygen or nitrogen atom capable of condensing with said acylating agent and further having a tertiary amino group; and (b) a quaternizing agent suitable for converting the tertiary amino group to a quaternary nitrogen wherein the quaternizing agent is selected from the group consisting of dialkyl sulfates, benzyl halides, hydrocarbyl substituted carbonates or hydrocarbyl epoxides in combination with an acid or mixtures thereof. In some embodiments the quaternary ammonium salt is a polyisobutylene succinimide quaternary ammonium salt dispersant.

The quaternary ammonium salt dispersant may also be a quaternary amide and/or ester dispersant which may be described as the reaction product of: (a) a non-quaternized amide and/or ester detergent having a tertiary amine functionality; and (b) a quaternizing agent. In some embodiments the non-quaternized detergent is itself the condensation product of (i) a hydrocarbyl-substituted acylating agent and (ii) a compound having an oxygen or nitrogen atom capable of condensing with said acylating agent and further having at least one tertiary amino group.

Suitable hydrocarbyl-substituted acylating agents suitable for preparing the quaternary ammonium salt dispersants of the present invention include any of those described above. In some embodiments the hydrocarbyl-substituted acylating agent is a polyisobutylenesuccinic anhydride.

The compound having an oxygen or nitrogen atom capable of condensing with said acylating agent and further having a tertiary amino group is reacted with the hydrocarbyl-substituted acylating agent along with a quaternizing agent to produce the quaternary ammonium salt dispersant. Suitable condensing compounds include any of the polyalkylene polyamine described above that contain a tertiary amino group. Suitable condensing compounds also include any of the amines described above which may be alkylated such that they contain a tertiary amino group. That is, suitable polyalkylene polyamines or the amines from which they are derived may either contain a tertiary amino group or may be alkylated until they contain a tertiary amino group, so long as the polyalkylene polyamine has at least one tertiary amino group when it is reacted with the hydrocarbyl-substituted acylating agent and the quaternizing agent.

In one embodiment, the condensing compound may be represented by one of the following formulas:

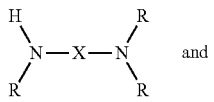

(VII)

and

-continued

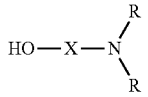

(VIII)

wherein, for both Formulas (VII) and (VIII), each X is independently an alkylene group containing 1 to 4 carbon atoms; and each R is independently a hydrocarbyl group.

Suitable compounds include but are not limited to; 1-aminopiperidine, 1-(2-aminoethyl)piperidine, 1-(3-aminopropyl)-2-pipecoline, 1-methyl-(4-methylamino)piperidine, 1-amino-2,6-dimethylpiperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), or combinations thereof. In some embodiments the amine used is 3-dimethylaminopropylamine, 3-diethylaminopropylamine, 1-(2-aminoethyl)pyrrolidine, N,N-dimethylethylenediamine, or combinations thereof.

Suitable compounds further include aminoalkyl substituted heterocyclic compounds such as 1-(3-aminopropyl) imidazole 4-(3-aminopropyl)morpholine, and 1-(2-aminoethyl)piperidine. Also suitable are amines such as 3,3-diamino-N-methyldipropylamine, 3'3-aminobis(N,N-dimethylpropylamine).

Still further nitrogen or oxygen containing compounds capable of condensing with the acylating agent which also have a tertiary amino group include: alkanolamines, including but not limited to triethanolamine, N,N-dimethylaminopropanol, N,N-diethylaminopropanol, N,N-diethylaminobutanol, N,N,N-tris(hydroxyethyl)amine, and N,N,N-tris (hydroxymethyl)amine.

Suitable quaternizing agents for preparing any of the quaternary ammonium salt detergents described above include dialkyl sulfates, benzyl halides, hydrocarbyl substituted carbonates, hydrocarbyl epoxides any of which may be used in combination with an acid, or mixtures thereof.

In one embodiment the quaternized salt includes one or more of the following anions: halides such as chloride, iodide or bromide; hydroxides; sulphonates; alkyl sulphates; phosphates; $C_{1-12}$ alkylphosphates; di-$C_{1-12}$ alkylphosphates; borates; $C_{1-12}$ alkylborates; nitrites; nitrates; carbonates; bicarbonates; alkanoates; O,O-di-$C_{1-12}$ alkyldithiophosphates; or mixtures thereof.

In one embodiment the quaternizing agent may be: a dialkyl sulphate such as dimethyl sulphate; N-oxides; sultones such as propane or butane sultone; alkyl, acyl or aralkyl halides such as methyl and ethyl chloride, bromide or iodide or benzyl chloride; hydrocarbyl (or alkyl) substituted carbonates; or combinations thereof. If the aralkyl halide is benzyl chloride, the aromatic ring is optionally further substituted with alkyl or alkenyl groups.

The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxide, as represented by the following formula:

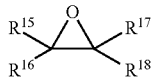

(IX)

wherein $R^{15}$, $R^{16}$, $R^{17}$ and $R^{18}$ can be independently H or a $C_{1-50}$ hydrocarbyl group. Examples of suitable hydrocarbyl epoxides include: styrene oxide, ethylene oxide, propylene oxide, butylene oxide, stilbene oxide, $C_{2-50}$ epoxides, or combinations thereof.

Any of the quaternizing agents described above, including the hydrocarbyl epoxides, may be used in combination with an acid. In some embodiments the quaternizing agents include any one or more of the hydrocarbyl epoxides described above in combination with an acid. Suitable acids include carboxylic acids, such as acetic acid, propionic acid, butyric acid, and the like.

The succinimide quaternary ammonium salt detergents of the present invention are formed by combining the reaction product described above (the reaction product of a hydrocarbyl-substituted acylating agent and a compound having an oxygen or nitrogen atom capable of condensing with said acylating agent and further having at least one tertiary amino group) with a quaternizing agent suitable for converting the tertiary amino group to a quaternary nitrogen. Suitable quaternizing agents are discussed in greater detail below. In some embodiments these preparations may be carried out neat or in the presence of a solvent.

The quaternary ammonium salts may be prepared in the presence of a solvent, which may or may not be removed once the reaction is complete. Suitable solvents include, but are not limited to, diluent oil, petroleum naphtha, and certain alcohols. In one embodiment, these alcohols contain at least 2 carbon atoms, and in other embodiments at least 4, at least 6 or at least 8 carbon atoms. In another embodiment, the solvent of the present invention contains 2 to 20 carbon atoms, 4 to 16 carbon atoms, 6 to 12 carbon atoms, 8 to 10 carbon atoms, or just 8 carbon atoms. These alcohols normally have a 2-($C_{1-4}$ alkyl) substituent, namely, methyl, ethyl, or any isomer of propyl or butyl. Examples of suitable alcohols include 2-methylheptanol, 2-methyldecanol, 2-ethylpentanol, 2-ethylhexanol, 2-ethylnonanol, 2-propylheptanol, 2-butylheptanol, 2-butyloctanol, isooctanol, dodecanol, cyclohexanol, methanol, ethanol, propan-1-ol, 2-methylpropan-2-ol, 2-methylpropan-1-ol, butan-1-ol, butan-2-ol, pentanol and its isomers, and mixtures thereof. In one embodiment the solvent of the present invention is 2-ethylhexanol, 2-ethyl nonanol, 2-methylheptanol, or combinations thereof. In one embodiment the solvent of the present invention includes 2-ethylhexanol.

In some embodiments the quaternary ammonium salt dispersant is derived from a polyisobutylenesuccinic anhydride and a polyalkene polyamine containing a tertiary amino group and a quaternizing agent, wherein the polyalkene polyamine includes aminopropylmorpholine, dimethylaminopropylamine, tris-(2-aminoethyl)amine, or combinations thereof. In some embodiments the quaternizing agent is a hydrocarbyl epoxide, such as propylene oxide or styrene oxide, and it used in combination with an acid.

In some embodiments the dispersant component of the present invention is one or more of the quaternary ammonium salt dispersants described above and is substantially free of (containing less than 5, 2, 1 or even 0.1 percent by weight) to free of any non-quaternary salt nitrogen-containing dispersant and/or succinimide dispersant described above. In any of these embodiments the quaternary ammonium salt dispersants may be derived from polyisobutylene have a number average molecular weight (Mn) of about 500, 700 or 800 to 5000, 3000, 1500, or 1200.

In other embodiments the dispersant component of the present invention may also contain ester dispersants in combinations with, or even instead of, the succinimide dispersants and quaternary ammonium salt dispersants described above.

The ester dispersant may be a carboxylic ester, prepared by reacting at least one or more of the above described hydrocarbyl substituted acylating agents where the agents contains at least one carboxylic acid group, with at least one organic hydroxy compound and optionally an amine. The hydroxy compound may be an alcohol or a hydroxy containing amine. In another embodiment, the carboxylic ester dispersant is prepared by reacting the acylating agent with at least one hydroxyamine. Preferred alcohols are polyhydric alcohols, such as pentaerythritol. The polyhydric alcohols may be esterified with monocarboxylic acids having from 2 or 8 to 30 or 18 carbon atoms, provided that at least one hydroxyl group remains unesterified. Examples of monocarboxylic acids include acetic, propionic, butyric and the above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be further reacted with at least one of the above described amines and in some embodiments at least one of the above described polyamines, such as a polyethylenepolyamine, condensed polyamine, or a heterocyclic amine, such as aminopropylmorpholine.

The Carrier Fluid

The compositions of the present invention also include a carrier fluid component. Suitable carrier fluids are not overly limited and include one or more mineral oils, alkylated benzenes, alcohols, polyol esters, and combinations thereof.

In some embodiments the carrier fluid includes a mineral oil, including heavy naphthenic distillates and petroleum middle distillates.

In some embodiments the carrier fluid includes a polyol ester and/or polyester oils, for example a trialkylol alkane tricarboxylate such as trimethylol propane trioleate (available commercially as EMERY™ 2964), trimethylol propane triisostearate (available commercially as EMERY™ 2951), trimethylol propane tripelargonate (available commercially as EMERY™ 2934) and combinations thereof. Suitable polyol ester and/or polyester oils also include pentaerythritol-based polyol esters, including pentaerythritol tetraoleate (available commercially as EMERY™ 2989) and other pentaerythritol-based oils, including HATCOL™ 2999 and similar oils. Suitable esters also include glycol-based dialkylates such as neopentylglycol dioleate (available commercially as EMERY™ 2965). Suitable carrier fluids also include trimethylpropane and/or methyl esters of fatty acids such as: a trimethylpropane esters of oleic acid (available commercially as SYNATIVE™ ES 2964); trimethylpropane esters of dimer acids, such as a mixture including a majority of isostearic acid (one example of which is available commercially as SYNATIVE™ 932T); and methyl esters of dimer acids, such as a mixture including a majority of isostearic acid (one example of which is available commercially as SYNATIVE™ 932M).

In some embodiments the carrier fluid includes an alcohol, and in some embodiments a branched alcohol. Suitable alcohols may have a 2-($C_{1-4}$ alkyl) substituent, namely, methyl, ethyl, or any isomer of propyl or butyl. Examples of suitable alcohols include 2-methylheptanol, 2-methyldecanol, 2-ethylpentanol, 2-ethylhexanol, 2-ethylnonanol, 2-propylheptanol, 2-butylheptanol, 2-butyloctanol, isooctanol, dodecanol, cyclohexanol, methanol, ethanol, propan-1-ol, 2-methylpropan-2-ol, 2-methylpropan-1-ol, butan-1-ol, butan-2-ol, pentanol and its isomers, and mixtures thereof. In one embodiment the solvent of the present invention is 2-ethylhexanol, 2-ethylnonanol, 2-methylheptanol, or combinations thereof. In one embodiment the alcohol is 2-ethylhexanol.

Any one or more of the carriers described above may be used or excluded from any of the described embodiments of the present invention.

The Corrosion Inhibitor

The compositions of the present invention optionally include a corrosion inhibitor. When present, the corrosion inhibitor is not overly limited. In some embodiments the corrosion inhibitor includes one or more fatty acids, esterified derivatives thereof, amine salts of dinonylnaphthalenesulfonic acid, and combinations thereof. Specific examples of suitable corrosion inhibitors include long chain fatty acid such as oleic acid, linoleic acid, and the like. The esterified and/or polyol versions of these acids may also be used, including glycerol monooleate and similar derivates of such acids. Amine salts of dinonylnaphthalenesulfonic acid may also be used in including the corrosion inhibitors commercially available under the trade name NA-SUL™ from King Industries. Specific examples include the basic metal salts of dinonylnaphthalenesulfonic acid where the acids are salted with an amine, including NA-SUL™ EDS (which is salted with ethylenediamine).

Suitable corrosion inhibitors also include amine salts of carboxylic acids, such as octylamine octanoate, condensation products of dodecenyl succinic acid or anhydride or a fatty acid, such as oleic acid with a polyamine, e.g. a polyalkylene polyamine such as triethylenetetramine, and half esters of alkenyl succinic acids in which the alkenyl radical contains about 8 to about 24 carbon atoms with alcohols such as polyglycols. The corrosion inhibitors can be used alone or in combination with other corrosion inhibitors.

Additional Additives.

The compositions of the present invention may further include one or more additional additives. These addition additives may include a foam inhibitor, a demulsifier, a detergent, a pour point depressant, a viscosity modifier, an antiwear additive, metal deactivator, and an antioxidant. When these additional additives are present, they may be used from 0, 0.0001, 0.001, 0.05, 0.1 or 0.5 to 10, 7.5, 5, or 1 percent by weight of the overall composition, where the various ranges may be applied to each additional additive individually or to all of the additional additives as a whole. In some embodiments, the additional additive is present with the carrier fluid component and represents any of the ranges provided above of the carrier component itself.

In some embodiments the compositions of the present invention include an ashless antiwear additive. Suitable antiwear additives include hydrocarbyl phosphoric acids or acid esters, hydrocarbyl thiophosphoric acids or acid esters, hydrocarbyl dithiophosphoric acids or acid esters, amine salts of one or more of these acids and acid esters, or combinations thereof.

Suitable detergents include neutral and overbased detergents. Suitable detergent substrates include, phenates, sulfur containing phenates, sulfonates, salixarates, salicylates, carboxylic acids, phosphorus acids, mono- and/or di-thiophosphoric acids, alkyl phenols, sulfur coupled alkyl phenol compounds, or saligenins. The detergent may be natural or synthetic. In one embodiment the detergent is synthetic. In one embodiment the detergent comprises a sulfonate detergent. The sulfonate detergent may also have corrosion inhibitor properties. Examples of suitable detergents include at least one of calcium dinonyl naphthalene sulfonate, calcium didecyl naphthalene sulfonate, didodecyl naphthalene sulfonate, calcium dipentadecyl naphthalene sulfonate, or mixtures thereof. In one embodiment the detergent comprises neutral or slightly overbased calcium dinonyl naphthalene sulfonate, or mixtures thereof.

Suitable antioxidants include alkylated diphenylamines, hindered phenols, molybdenum dithiocarbamates, and mixtures thereof. Suitable anti-oxidants also include alkylated alpha-phenyl naphthyl amines. Antioxidant compounds may be used alone or in combination with other antioxidants. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol or 2,6-di-tert-butylphenol, Suitable examples of molybdenum dithiocarbamates which may be used as an antioxidant include commercial materials sold under the trade names such as Vanlube 822™ ad Molyvan™ A from R. T. Vanderbilt Co., Ltd., and Adeka Sakura-Lube™ S-100, S-165 and S-600 from Asahi Denka Kogyo K. K and mixtures thereof. Suitable alkylated diphenylamines include bis-nonylated diphenylamine, nonyl diphenylamine, octyl diphenylamine, bis-octylated diphenylamine, di-t-butylated diphenylamine, bis-decylated diphenylamine, decyl diphenylamine, bis-styrenated diphenylamine, styrenated di-phenylamine, and mixtures thereof.

Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth) acrylic acid ester, a polyalkylstyrene, an alkenylaryl conjugated-diene copolymer, an ester of maleic anhydride-styrene copolymer or mixtures thereof. In some embodiments the viscosity modifier is a poly(meth)acrylic acid ester, an olefin copolymer or mixtures thereof.

Suitable foam inhibitors include polyacrylates, such as copolymers of ethyl acrylate and 2-ethylhexylacrylate, and optionally vinyl acetate; demulsifiers including polyglycol derivatives, trialkyl phosphates, polyethylene glycols, polyethylene oxides, polypropylene oxides, polyethers and (ethylene oxide-propylene oxide) polymers, polysiloxane and fluorosiloxane polymers and copolymers.

Suitable pour point depressants include esters of maleic anhydride-styrene, poly(meth)acrylates, polyacrylates or polyacrylamides; may also be used in the lubricant compositions of the invention.

Suitable demulsifiers include derivatives of propylene oxide, ethylene oxide, polyoxyalkylene alcohols, alkyl amines, amino alcohols, diamines or polyamines reacted sequentially with ethylene oxide or substituted ethylene oxides and mixtures thereof. Demulsifiers can be used alone or in combination. Examples of demulsifiers include but are not limited to trialkyl phosphates, polyethylene glycols, polyethylene oxides, polypropylene oxides, (ethylene oxide-propylene oxide) copolymers and mixtures thereof. In one embodiment the demulsifier is ethylene oxide-propylene oxide copolymer.

Suitable metal deactivators include derivatives of benzotriazoles, 1,2,4-triszoles, benzimidazoles, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. The metal deactivator may be used alone or in combination with other metal deactivators.

Examples of suitable a benzotriazole include those with hydrocarbyl group with substitutions on at least one ring position, such as, position 1- or 2- or 4- or 5- or 6- or 7- or mixtures thereof. The hydrocarbyl group includes 1 to about 30 carbon atoms, in one embodiment 1 to about 15 carbon atoms, in another embodiment 1 to about 7 carbon atoms. In one embodiment the benzotriazole is 5-methylbenzotriazole (tolyltriazole) or mixtures thereof. In one embodiment hydrocarbyl benzotriazole may be substituted at positions 4- or 5- or 6- or 7- and further reacted with an aldehyde and a secondary amine to form a Mannich product such as N,N-bis(heptyl)-ar-methyl-1H-benzotriazole-1-methanamine; N,N-bis(nonyl)-ar-methyl-1H-benzotriazole-1-methanamine.

When the metal deactivator is a 2,5-bis(alkyl-dithio)-1,3,4-thiadiazole or 2-monoalkyl-dithio-mercapto-1,3,4-thiadiazole the alkyl groups include 1 to about 30 carbon atoms, in one embodiment about 2 to about 25 carbon atoms, in another embodiment about 4 to about 20 and in yet another embodiment about 6 to about 16 carbon atoms. Examples of a suitable 2,5-bis(alkyl-dithio)-1,3,4-thiadiazole include 2,5-bis(alkyl-dithio)-1,3,4-thiadiazole, 2,5-bis(tert-nonyldithio)-1,3,4-thiadiazole or mixtures thereof. Examples of a suitable 2-monoalkyl-dithio-mercapto-1,3,4-thiadiazole include 2-monononyl-dithio-mercapto-1,3,4-thiadiazole, 2-monododecyl-dithio-mercapto-1,3,4-thiadiazole or mixtures thereof.

INDUSTRIAL APPLICATION

The compositions of the present invention include (a) a dispersant component comprising a nitrogen-containing dispersant and/or a quaternary ammonium salt dispersant; (b) a carrier fluid component; and (c) an optional corrosion inhibitor. In some embodiments (a) is present from 0.5 to 55 percent by weight; and component (b) is present from 45 to 99.5 percent by weight. In other embodiments (a) is present from 0.5 to 55 percent by weight; component (b) is present from 44.0 to 99.45 percent by weight; and component (c) is present from 0.05 to 1.0 percent by weight.

In still other embodiments: (a) may be present from 0.5, 0.75 or 1 up to 8, 9 or 10 percent by weight, (b) may be present from 44, 45, 59, 60, 74, 79 or 80 up to 99.5, 99, 92, 90, or even 89 percent by weight or may be present from 44, 45, 59 or 60 up to 90, 89, 80, 79, or even 74 percent by weight; (c) may be present from 0, 0.01 or 0.05 up to 1, 0.5 or even 0.4 percent by weight. All of these ranges are on an actives, oil/solvent free basis.

The compositions of the present invention may be used as clean-up fluids for cleaning lubricant systems, such as the lubricant systems of hydraulic equipment. The composition of the present invention may be used as a top treat into the lubricant already present in the equipment's lubricant system. In some embodiments the lubricant is drained from the system and a composition of the present invention is added by itself. In some embodiments, the compositions of the present invention may also be used as a lubricant composition. However, in other embodiments the compositions of the present invention are not fully-formulated lubricant compositions themselves, but rather are only clean-up fluids designed for cleaning the system and not lubricating it during general and/or long term operation.

In some embodiments the compositions of the present invention are hydraulic system clean-out compositions and/or lubricants. In some embodiments the compositions of the present invention are used in hydraulic systems in plastic injection molding machines, hydraulic presses, steam or gas powered turbines, and the like. Any one or more of these listed embodiments may be excluded from the present invention.

The present invention also provides methods of cleaning out the lubricant systems of one or more of any of the types of equipment described above. The methods of the present invention include the steps of: (i) supplying a sufficient amount of a composition of the present invention to a lubricant system such that the system may be safely operated; and (ii) operating said system to circulate the composition throughout the system; and optionally (iii) draining the lubricant system removing the both the composition and the deposits the composition removed, resulting in the removal of deposits from the lubricant system. By "sufficient amount" and "safely operated", it is meant that enough fluid is present in the system for the fluid to circulate throughout the lubricant system and to provide the minimal needed lubrication of the equipment to prevent damage during the clean-up cycle. In some embodiments the sufficient amount means the lubricant system is filled with the composition of the present invention to within the same range of levels and/or level that the system would normally be filled with lubricant. In some embodiments, safely operated means the equipment can operate without suffering any significant damage due to a lack of lubrication over the course of the cleaning cycle. In some embodiments this cycle time may range from 400, 200, 100, 72, 48, 24, 12, 6 to 4 hours.

In some embodiments the piece of equipment whose lubricant system is being cleaned out is operated during the cleaning cycle under zero load conditions, low load conditions, less than normal load conditions or some other similar reduced load, power, and/or stress conditions. This is important in some embodiments as the compositions of the present invention are not always intended to be fully formulated lubricants, but rather to be only clean-up fluids. Operation of equipment at or near full load conditions without a fully formulated lubricant present in the lubricant system may result in damage to the piece of equipment. In such embodiments the composition may not be optimized for performing the same function as the originally supplied lubricant. In order not to cause undue stress to the equipment of the system, such compositions can be circulated through the system at or near as low a pressure as possible.

In some embodiments the equipment whose lubricant system is being cleaned out may include filters and/or deposit collecting elements in its lubricant system. In such embodiments the methods of the present invention may also include a step where such elements are cleaned, emptied and/or replaced before, during and/or after the circulation of the compositions of the present invention. This would allow for the removal of more deposits from the system, assessment of the condition of the system before and after cleaning, and/or ensure the system is as clean as possible after the cleaning cycle is completed.

The clean-up methods of the present invention may be completed in several different ways. In some embodiments the lubricant system of the piece of equipment is first completely drained of lubricant and replaced with a sufficient amount of a composition of the present invention. The system is then cleaned by operating the equipment and/or system and allowing the composition to circulate through the equipment's lubricant system. The composition may then be drained and the deposits removed. At the end of the clean-up cycle, fresh lubricant can then be added back to the cleaned system.

In other embodiments the lubricant system is partially drained of lubricant and the drained portion of lubricant is replaced with a sufficient amount of composition of claim 1 so as to allow the safe operation of the system and circulation of the composition. The clean up cycle is then completed as described above. In still other embodiments the lubricant is not drained from the lubricant system, but rather is left in the equipment's lubricant system. A composition of the present invention is then added as a top-treatment to the lubricant in the system. The clean up cycle is then completed as described above. In such embodiments, a more concentrated composition, containing reduced amounts of carrier fluid may be used, thus the same relative amount of active chemistry is added to the system as in the embodiments described above.

In some embodiments the compositions of the present invention, particularly when used as a lubricant top treatment, may be left in the equipment for an extended period of time, providing clean-up performance during the regular operation of the equipment.

In some embodiments the methods of the present invention include the steps of: (i) supplying a sufficient amount of the compositions described above to a lubricant system, per any of the embodiments described above, and (ii) operating said system to circulate the composition throughout the system. The method results in the removal of deposits from the lubricant system. The methods of the present invention may further include the step: (iii) after operating said system, circulating the composition and removing the deposits, draining the lubricant system of the compositions, any lubricant that may still be present, and any deposits that have been removed from the system present in the composition. The system may then be refilled with fresh lubricant.

The methods of the present invention may further also include the step: (iv) optionally circulating the added fresh lubricant in order to flush the system, which may again be under zero and/or low load conditions. The flush may then be drained from the lubricant system. This flush is an optional step, but may also be repeated as needed to ensure the lubricant system is clean. Fresh lubricant may then be added to the system and the piece of equipment may then be operated normally.

It is known that some of the materials described above may interact in the final formulation, so that the components of the final formulation may be different from those that are initially added. The products formed thereby, including the products formed upon employing the composition of the present invention in its intended use, may not be susceptible to easy description. Nevertheless, all such modifications and reaction products are included within the scope of the present invention; the present invention encompasses the composition prepared by admixing the components described above.

EXAMPLES

The invention will be further illustrated by the following examples, which set forth particularly advantageous embodiments. While the examples are provided to illustrate the present invention, they are not intended to limit it.

Example Set 1

The following examples, summarized in the table below, are prepared by blending the components listed under conditions ranging from ambient temperature up to, and including, about 80° C.

TABLE 1

Example Set 1 Formulations[1]

| Component | Ex 1-A | Ex 1-B | Ex 1-C | Ex 1-D | Ex 1-E | Ex 1-F | Ex 1-G |
|---|---|---|---|---|---|---|---|
| Succinimide Dispersant[2] | | | 28.5 | | | | |
| Quat Salt Dispersant[3] | 0.75 | 7.5 | | 37.5 | 37.5 | 37.5 | 37.5 |
| Mineral Oils | 77.2 | | 21.5 | | | | |
| EMERY ™ 2694 | | 57.6 | | | | | |
| EMERY ™ 2694A | | | | | 49.5 | 49.5 | |
| EMERY ™ 2969B | | | 32.0 | 32.0 | | | |
| HATCOL ™ 2999 | | 32.4 | 18.0 | 18.0 | | | |
| SYNATIVE ES 932 | | | | | | | 49.5 |
| 2-Ethylhexanol | 0.25 | 2.5 | | 12.5 | 12.5 | 12.5 | 12.5 |
| Alkylated Benzene | 21.8 | | | | | | |
| Oleic Acid | | | | | 0.5 | | 0.5 |
| Glycerol Monooleate | | | | | | 0.5 | |

[1]All formulation values are percent by weight on an oil/solvent free basis.
[2]The succinimide dispersant used in Ex 1-C is derived from a polyisobutylenesuccinic anhydride and a polyalkylene polyamine.
[3]The quaternary ammonium salt dispersant, used in all the examples except Ex 1-C, is derived from a polyisobutylenesuccinic anhydride, a polyalkylene polyamine and a hydrocarbyl epoxide used in combination with a carboxylic acid.

The examples in Example Set 1 include formulations with typical actives levels that may be used in the methods of the present invention where all of the lubricant is drained and the clean-up fluid is added to an empty lubricant system (see Examples 1-A and 1-B). Example Set 1 also includes more concentrated formulations that may be used in the methods of the present invention where only a portion or none of the lubricant is drained and the clean-up fluid is added to the lubricant remaining in the lubricant system (see Examples 1-C, 1-D, 1-E, 1-F and 1-G).

Example 2

Example 1-A from the table above is tested in a valve stick test stand which had heavy deposits from prior operation. The test stand uses an Eaton 20VQ vane pump, to circulate the fluid and a Vickers valve KFTG4. The test stand was run for 498 hours and some cleaning of the lubricant system reservoir was observed. Additional quaternary ammonium salt dispersant was then added, bringing the quaternary ammonium salt dispersant content of the composition up to 7.5 percent by weight on a solvent free basis. The test stand was then run for an additional 115 hours. The test conditions during the clean up cycle are summarized in the table below. Significant improvement in the cleanliness of the system was observed by monitoring the test stand response curves and specifically the response curve of the valve spool before and after the addition of the experimental composition. The results indicate that the addition of the experimental composition resulted in the removal significant amounts of the deposits which were not removed by the standard lubricant used in the prior operation of the system.

TABLE 2

| Clean Up Cycle Test Conditions | |
|---|---|
| Parameter | Value |
| Temperature at pump inlet | 26.7° C. (80° F.) |
| Speed | 1650 rpm |
| Pressure at pump inlet | 1379 kPa (200 psi) |
| Oil Sump | 22.7 L (6 gallon) |
| Run Time | 115 hour |

Example 3

Example 1-B from the table above is tested in a valve stick test stand which had heavy deposits from prior operation using the same procedure outlined in Example 2 except that the prior operation period for this example was 306 hours. Once the lubricant was replaced with Example 1-B the test stand was run under the conditions outlined in Table 2 above except that the clean up cycle run time here was only 25 hours. At the end of the clean up cycle virtually all of the deposits were removed when the composition was drained from the system.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values are percents by weight and all ppm values are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What we claim:

1. A clean-out composition comprising:

(a) a dispersant component comprising (i) a succinimide dispersant and a quaternary ammonium salt dispersant; or (ii) a quaternary ammonium salt dispersant;

(b) a carrier fluid component; and (c) an optional corrosion inhibitor;

wherein said quaternary ammonium salt dispersant is prepared from:

(a) the reaction product of (i) a hydrocarbyl-substituted acylating agent and (ii) a compound having an oxygen or nitrogen atom capable of condensing with said acylating agent and further having a tertiary amino group; and (b) a hydrocarbyl epoxide quaternizing agent suitable for converting the tertiary amino group to a quaternary nitrogen; and wherein said clean-out composition is free of a detergent component.

2. The composition of claim 1 wherein component (a) is present from 0.5 to 55 percent by weight; and component (b) is present from 45 to 99.5 percent by weight.

3. The composition of claim 1 wherein component (c) is present and wherein: component (a) is present from 0.5 to 55 percent by weight; component (b) is present from 44.0 to 99.45 percent by weight; and component (c) is present from 0.05 to 1.0 percent by weight.

4. The composition of claim 1 further comprising an ashless antiwear additive selected from the group consisting of a hydrocarbyl phosphoric acid or acid ester, a hydrocarbyl thiophosphoric acid or acid ester, a hydrocarbyl dithiophosphoric acid or acid ester, an amine salt of one or more of these acids and acid esters, or combinations thereof.

5. The composition of claim 1 further comprising one or more additional additives selected from the group consisting of a foam inhibitor, a demulsifier, a pour point depressant, a viscosity modifier, an antiwear additive, metal deactivator, and an antioxidant; wherein said additional additives are present from 0 to 10 percent by weight of the overall composition.

6. The composition of claim 1 wherein component (b), the carrier fluid component, comprises one or more of a mineral oil, an alkylated benzenes, an alcohol, a polyol ester, or combinations thereof and wherein component (c), the corrosion inhibitor component, comprises one or more of a fatty acid, an esterified derivative thereof, an amine salt of dinonylnaphthalenesulfonic acid or, combinations thereof.

7. The composition of claim 1 wherein the lubricant and/or clean-out composition is a hydraulic system lubricant and/or clean-out composition or a turbine lubricant and/or clean-out composition.

8. A method of cleaning out a lubricant system of a piece of equipment comprising the steps of:

(i) supplying a sufficient amount of the composition of claim 1 to a lubricant system such that the system may be safely operated;

(ii) operating said system to circulate the composition throughout the system;

resulting in the removal of deposits from the lubricant system.

9. The method of claim 8 wherein the piece of equipment is operated at low load settings and/or conditions; and wherein optionally any filters and/or deposit collecting elements in said lubricant system are clean, emptied and/or replaced before, during and/or after the circulation of the composition of claim 1.

10. The method of claim 8 wherein:

(a) the lubricant system is first completely drained of lubricant and replaced with a sufficient amount of composition of claim 1 so as to allow the safe operation of the system and circulation of the composition;

(b) the lubricant system is first partially drained of lubricant and said drained portion is replaced with a sufficient amount of composition of claim 1 so as to allow the safe operation of the system and circulation of the composition; or (c) the lubricant is not drained from the lubricant system and the composition of claim 1 is added as a top-treatment to the lubricant in the system.

11. The method of claim 8 wherein the method further comprises the steps:

(iii) after operating said system and removing the deposits, draining the lubricant system, including the composition of claim 1, and refilling the system with fresh lubricant; and (iv) optionally circulating said fresh lubricant to flush the system, then draining the lubricant system again removing the lubricant used to flush the system, and refilling the system with fresh lubricant.

12. A composition of claim 1 wherein said hydrocarbyl epoxide quaternizing agent for converting said tertiary amino group to a quaternary nitrogen is used in combination with an acid.

13. A composition of claim 12 wherein said acid used in combination with said hydrocarbyl epoxide quaternizing agent for converting said tertiary amino group to a quaternary nitrogen is selected from acetic acid, propionic acid, and butyric acid.

14. A composition of claim 1 wherein said compound capable of condensing with said acylating agent and further having a tertiary amino group is selected from a compound represented by formulas (VII) and (VIII) as follows:

(VII)

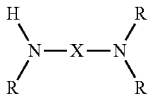

(VIII)

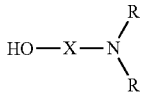

wherein, for both Formulas (VII) and (VIII), each X is independently an alkylene group containing 1 to 4 carbon atoms; and each R is independently a hydrocarbyl group.

15. A composition of claim 1 wherein said hydrocarbyl epoxide quaternizing agent is represented by formula (IX) as follows:

(IX)

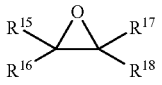

wherein $R^{15}$, $R^{16}$, $R^{17}$ and $R^{18}$ can be independently H or a $C_{1-50}$ hydrocarbyl group.

16. A composition of claim 1 wherein said hydrocarbyl-substituted acylating agent is polyisobutylenesuccinic anhydride.

17. A composition of claim 1 wherein said compound capable of condensing with said acylating agent and further having a tertiary amino group is selected from 1-aminopiperidine, 1-(2-aminoethyl)piperidine, 1-(3-aminopropyl)-2-pipecoline, 1-methyl-(4-methylamino)piperidine, 1-amino-2,6-dimethylpiperidine, 4-(1-pyrrolidinyl)piperidine, 1-(2-aminoethyl)pyrrolidine, 2-(2-aminoethyl)-1-methylpyrrolidine, and combinations thereof.

18. A composition of claim 14 wherein said compound capable of condensing with said acylating agent and further having a tertiary amino group is selected from N,N-diethylethylenediamine, N,N-dimethylethylenediamine, N,N-dibutylethylenediamine, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), and combinations thereof.

19. A composition of claim 15 wherein said hydrocarbyl epoxide quaternizing agent is selected from styrene oxide, ethylene oxide, propylene oxide, butylene oxide, stilbene oxide, $C_{2-50}$ epoxides, and combinations thereof.

* * * * *